US005098770A

United States Patent [19]

Paire

[11] Patent Number: 5,098,770

[45] Date of Patent: Mar. 24, 1992

[54] COMPOSITE FIREPROOF AND WATERPROOF TEXTILE AND CLOTHING AND SEAT COMPRISING SUCH A TEXTILE

[75] Inventor: Christian Paire, Roisel, France

[73] Assignee: Lainiere de Picardie, Peronne, France

[21] Appl. No.: 422,388

[22] Filed: Oct. 16, 1989

[30] Foreign Application Priority Data

Oct. 14, 1988 [FR] France ..... 88 13563

[51] Int. Cl.[5] ..... B32B 27/14

[52] U.S. Cl. ..... 428/198; 2/97; 2/272; 297/DIG. 5; 428/284; 428/287; 428/300; 428/920

[58] Field of Search ..... 428/284, 287, 198, 300, 428/920; 2/97, 272; 297/DIG. 5

[56] References Cited

U.S. PATENT DOCUMENTS

| | | | |
|---|---|---|---|
| 3,532,588 | 10/1970 | Newman | 428/198 |
| 3,922,418 | 11/1975 | Lauchenauer | 428/198 |
| 4,143,424 | 3/1979 | Knoke et al. | 428/198 |
| 4,373,000 | 2/1983 | Knoke et al. | 428/198 |
| 4,438,533 | 3/1984 | Hefele et al. | 428/198 |
| 4,486,902 | 12/1984 | Sakai | 428/198 |
| 4,490,425 | 12/1984 | Knoke et al. | 428/198 |
| 4,781,962 | 11/1988 | Zamarripa et al. | 428/198 |
| 4,906,492 | 3/1990 | Groshens | 428/198 |

*Primary Examiner*—James J. Bell

*Attorney, Agent, or Firm*—Mason, Fenwick & Lawrence

[57] ABSTRACT

A composite textile is formed of a first non-woven needled textile layer, a second microporous film layer, and a discontinuous adhesive layer between the first and second layers to fix the first and second layers together. The first non-woven needled textile layer has a thermostable fiber basis, while the second microporous film layer is inflammable and is impermeable to liquid, but permeable to water vapor.

Protective clothing is formed having an outer textile layer and a lining with an insert mounted loosely between the outer textile layer and lining. The insert comprises a composite textile as described above with the first layer of the composite textile facing towards the lining. The composite textile can also be used in a seat with the composite textile placed between an outer textile layer and the foam elements of the seat, with the first layer of the composite textile facing towards the foam elements of the seat.

19 Claims, 1 Drawing Sheet

Figure 1:
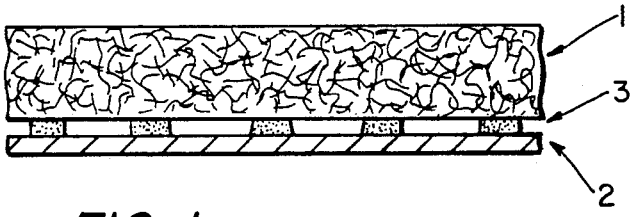

COMPOSITE FIREPROOF AND WATERPROOF TEXTILE AND CLOTHING AND SEAT COMPRISING SUCH A TEXTILE

The perfecting of new thermostable fibers has led to the rapid development of fireproof textiles.

These textiles, woven, knitted or non-woven, generally have good fire resistance but it is often necessary to make them waterproof.

This requirement has numerous origins. When these fireproof textiles are used for making protective clothing, for example intended for fire-fighting personnel, the latter must be able to be permanently sprayed with water to continue their activities with a maximum of ease. In other curcumstances, the same clothing provides protection against oils or hydrocarbons. Morever, as will be discussed hereafter, during the manufacture of seats it may be desirable to provide sealing between the inside of the seat and a textile fireproof layer.

To overcome these problems, different attempts have been made in which a fireproof textile after its manufacture is subjected to a water and oil proofing treatment so as to avoid penetration and possible damping of the textile support by water or oil.

This treatment has a number of drawbacks, it is likely to reduce the fire resistance capacity of the textile and further it generally withstands maintenance badly. In particular, the waterproofing of the fabric obtained is not stable and decreases during washing or dry cleaning. It is thus difficult to obtain a resistance to a water columnn greater than 300 mm.

In addition, water vapour and carbonic gas permeable and impermeable films are known often called "breathable materials".

The problem at the base of the invention is the construction of a composite fireproof and waterproof textile having good performances and being stable in time. It should have good fire resistance, good impermeability and good mechanical strength.

Furthermore, the invention also relates to the production of clothing or seats incorporating the textile of the invention so as to make the best use of its properties. The clothing and the seat thus formed must be comfortable.

For this, a composite textile is provided comprising a first non-woven needled textile layer with a thermostable fiber basis which also comprises a second layer formed of a microporous and liquid impermeable film, permeable to water vapour, uninflammable, and a discontinuous adhesive layer, placed between the first textile layer and the second layer for fixing the second to the first textile layer.

Protective clothing is also provided comprising an outer textile assembly forming its outer surface and a lining forming its inner surface, characterized in that it comprises an insert mounted loosely between the outer textile and the lining, said insert being a composite fireproof and liquid impermeable textile comprising a first nonwomen, needled textile layer with a thermostable fiber basis, a second layer formed of a microporous and liquid impermeable film, permeable to water vapour, uninflammable and a discontinuous adhesive layer, placed between the first textile layer and the second layer for fixing the second layer to the first textile layer, the first layer of the composite textile being placed towards the lining.

There is further provided a seat comprising a textile covering and foam elements, which comprises an insert mounted loosely between the outer textile and the foam elements, said insert being a composite fireproof impermeable textile comprising a first non-woven, needled textile layer with a thermostable fiber basis, a second layer formed of a microporous and liquid impermeable film, permeable to water vapour and to carbonic gas, and a discontinuous adhesive layer, placed between the first textile layer and the second layer for fixing the second layer to the first textile layer, the first layer of the composite textile being placed toward the textile lining.

Figure 4:
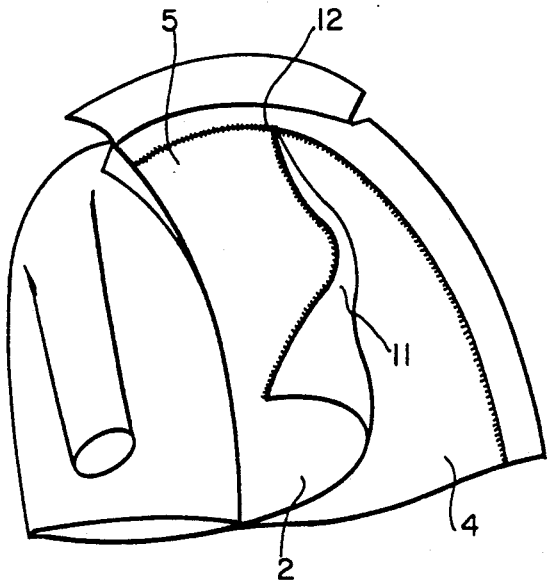
Figure 2:
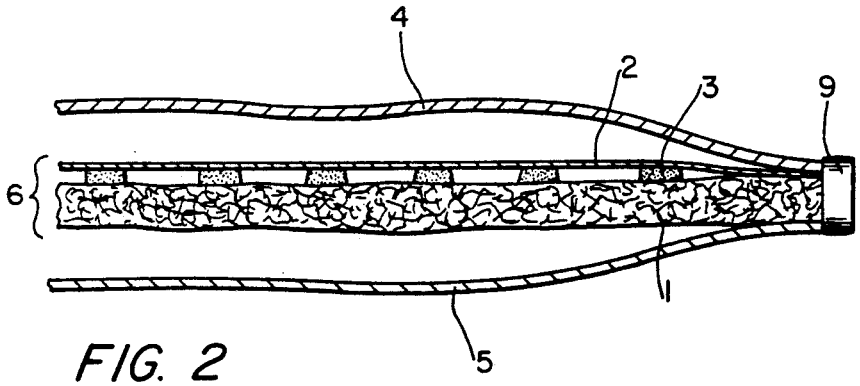
Figure 3:
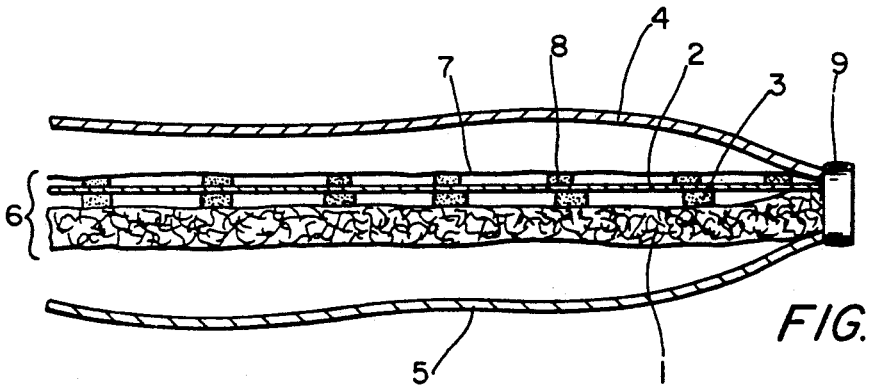

The invention will be described hereafter in detail with reference to the accompanying drawings in which : p FIG. 1 is a sectional representation of a composite textile of the invention, FIG. 2 is a partial sectional representation of a piece of clothing in accordance with the invention in a first embodiment, FIG. 3 is a partial sectional representation of a piece of clothing in accordance with the invention in a second embodiment, FIG. 4 is a partial sectional representation of a piece of clothing according to the invention in a third embodiment.

The textile of the invention comprises a first nonwoven, needled textile layer 1 having a thermostable fiber basis.

The use of a non-woven, needled material containing an appreciable volume of air makes it possible to obtain excellent fire resistance for a relatively low weight. By way of example, a weight of 100 to 150 g $m^2$ allows a textile to be obtained having very good properties.

The use of a needled material also avoids chemical bonding of the fibers which may decrease the fire resistance qualities. The fibers used may be either thermostable by nature or fireproofed after their manufacture.

The fibers are for example made from meta or para aramide, polyamide-imide, polyacrylate, polybenzimidazole, aromatic copolyimide, polyacrylonitrile oxide, polyacrylate, phenylene polysulfide, ketone polyester ether, FR viscose, cotton, Zirpo or a phenolic compound or else fluorocarbonated or modacrylic. A mixture of these thermostable fibers may be also be used.

These fibers may also be chlorofibers, viscose, polyester or wool fibers. They must then have been subjected to a fireproofing treatment. By way of example, the first layer may be a layer of a non-woven, needled material based on polyamide-imide thermostable fibers. These fibers having a cut length of 40 to 60 mm for a denier of 2.2 to 3 decitex.

For a weight of 200 g/$m^2$ and a thickness of 4 mm, this felt contains 40 to 50 by volume of air imprisoned between the fibers, thus offering excellent heat insulation to cold or fire.

The second layer 2 is formed of a film connected to the first one by a discontinuous adhesive layer 3. This layer is liquid impermeable and permeable to water vapour. This type of layer is often called "breathable". It is a layer impermeable to liquids but letting water vapour and carbonic gas pass freely therethrough.

Thus, this layer while playing a role of barrier to the liquid makes it possible to avoid condensation of perspiration and offers the user high comfort. It is formed of a sealed impermeable film, for example made from polyurethane or polyamino acid, heaving micro perforations or pores of a diameter of 0.2 microns which allow the water molecules and carbonic gas to flow but not liquid water.

Preferably, this "breathable" film is based on fireproofed polyurethane, for example by adding a nitrogenized and phosphorated additive. This film, made by a coagulation method, has a microporous structure with pores of about 0.2 microns and a thickness of 25 to 50 microns depending on the final requirements of the composite textile. In a preferred embodiment, the first textile layer 1 and the second layer 2 of the composite textile of the invention formed by a film are bonded together by means of an adhesive layer 3.

Numerous bonding methods may be used. However, it is necessary for the adhesive layer to be discontinuous, for example formed of adhesion spots so as to provide for the flow of water vapour through the bonding means and so through the whole of the composite textile. By using known means, bonding may be obtained having high resistance to cleaning and washing.

The bonding may be provided by spots comprising thermoplastic polymers of polyamide, polyester, polyurethane type, . . . polymers cross-linkable by themselves such as two component polyurethanes, ethylene-acrylic acid copolymers, ethylene-acrylic ester-maleic anhydride terpolymers . . . , or by the action of cross-linking agents incorporated in the adhesive such as a formaldehyde melamine resin, a formaldehyde urea resin, a formaldehyde phenol resin, an alkaline metal hydroxide, a zinc or zirconium complex, polyamines, epoxies, polyfunctional aziridines...

Preferably, the thermoadhesive polymer used will itself by uninflammable. The addition of chlorated antimony trioxide will confer this quality thereon. This arrangement which improves the quality of the composite textile is not always necessary.

The spots are deposited in the form of a paste or powder or else sprinkled over one of the two layers 1 and 2 and the association of the two layers 1, 2 is provided conventionally in a press.

Thus a line of aqueous phase paste spots deposited by silk-screen coating followed by a calendering line may be used. Thus, using a cylinder perforated at 11 mesh, namely 23 holes/cm$^2$, a cross-linkable polymer based formulation is deposited on one of the substrates, and preferably on the non-woven, needled material.

The deposition takes place at a rate of 15-20 m/mn about 30 g/m$^2$ humid on the substrate, at the output from the oven set at 130° C. a dry weight of 10-12 g/m$^2$ is obtained on which the microporous film is immediately applied at the outlet from the oven using a cooled calender. By subsequent heat treatment, at 150° C. for a minute, the final cross-linking of the bonding agent is obtained.

The composite textile after 24 hours rest has the required properties for providing perfect protection in fire fighting clothing.

The bonding may also be obtained using the foaming process, namely by inserting an adhesive foam between the two layers 1, 2 by uneven coating on the two faces to be bonded together.

The adhesive layer 3 may further be formed by spraying a liquid adhesive, such as polyurethane, possible cross-linkable. The spraying is then advantageously carried out on one of the supports, the second one being applied to the first one by calendering.

The adhesive layer 3 may also be formed by spraying "hot melt" which is humidity cross-linkable and has an application temperature of 80 ° to 110° C., it is sprayed on the non-woven, needled material or the film by means of a battery of traditional guns. Then, the second substrate is applied by cold calendering. The operation may be begun again a second time if it desired to apply a jersey material made from thermostable fibers at a weight between 50 and 130 g/m$^2$ on the face of the film and/or on the face of the non-woven, needled material still free.

The adhesive thus partially applied to a weight of 6 to 10 g/m$^2$ cross links in humidity in 24 hours and makes it possible to obtain adhesion withstanding the different cleaning operations, a considerable flexibility of the complex by pinpoint bonding and thus, by assembling the film and a woven or light knitted material made from thermostable or fireproofed fibers, makes it possible to improve the tear strength of the non-woven, needled material and the resistance to abrasion of the film during maintenance and when worn.

For forming the adhesive film 3 is is also possible to use thermobonding veils, films or lattices on which each of the layers 1, 2 of the composite textile are applied under a press or even by simple calendering.

Thus, a composite textile according to the invention is a good water repellent, a suitable choice of the second layer makes it possible for it to withstand without difficulty a water colum of about 7000 mm.

The main tests are given for checking the good breathability of the complex and its impermeability to water and hydrocarbons.

The water inlet pressure (hydrostatic resistance) is measured using the Federal Standard 191 method 5512 (MULLEN test) without external fabric or lining, and we obtain a value of 500 kPa, whereas the value of 310 kPa is considered as sufficient to provide complete impermeability under all weather conditions.

The breathability of an impermeable complex and which breathes is determined by measuring the resistance to transmission of wet vapour according to the Standard DIB 54 101 part 1 and which gives a resistance to the passage of water vapour (HET) of 0.155 m$^2$.mbar/w. According to the same standard a value lower than 0.200 is required to provide good breathability of the complex.

The chemical resistance is measured according to the standard NFS 74 302 and the impermeability to acids, bases and hydrocarbons is greater than 90%.

The convective protection index to a flame of 1050° C. according to the standard ISO DP 9151 gives a protection index of 25 seconds whereas a leather jacket traditionally used by firemen offers an index of 12 seconds and which is 2 to 4 times heavier than a jacket made with the composite textile of the invention.

In a preferred embodiment, the composite fireproof impermeable textile comprises a third textile layer 7 placed on the side opposite the first textile layer with respect to the second, a second discontinuous adhesive layer 8 placed between the third textile layer and the second layer for fixing the third textile layer to thee second layer.

The adhesive layer 8 fixing the third textile layer on the breathable film 2 is of the same kind as the above described adhesive layer 3. It may have any one of the above described compositions given in connection with the adhesive layer 3. The application of th adhesive layer 8 may also be made in a way similar to that of layer 3.

Safety and/or firefighting clothing which is particularly eficient and light may be formed with the composite textile of the invention.

Such protective clothing, shown in FIGS. 2 to 4, comprises an outer textile assembly, forming its outer surface and a lining 5 forming its inner surface. It comprises an insert 6 mounted loosely between the outer textile 4 and the line 5, said insert being made from a composite fireproof and liquid impermeable textile comprising a first non-woven, needled textile layer 1 with a thermostable fiber basis, permeable to water vapour, uninflammable and a discontinuous adhesive layer 3, placed between the first textile layer 1 and the second layer 2 for fixing the second layer 2 to the first textile layer 1, the first layer of the composite textile being placed towards the lining.

In this case, the second impermeable layer 2 is placed towards the outer side of the clothing. This arrangement protects the thermostable fiber layer 1 from water or any other liquid (hydrocarbons) . . . when the clothing is sprayed.

Thus, even when the clothing is subjected to considerable spraying due to the atmospheric conditions or to the technique of protecting firemen during their, firefighting duties, the clothing remains relatively light and does not hinder the movements of the one wearing it.

Inset 6 is mounted loosely between the outer textile 4 and the lining 5, which means that it is fixed similtaneously to the outer textile 4 and to the lining by its periphery 9 during manufacture, for example by sewing along the usual stitching lines of the lining to the outer textile 4. Outside these lines, insert 6 is free, between the outer textile 4 and lining 5 and without being otherwise fixed to these elements.

In a preferred embodiment, insert 6 and lining 5 form an assembly 11 dissociable from the outer assembly 4. It may be for example joined to the outer assembly by a sliding fastener 12. During maintenance of the jacket, insert 6 and lining 5 may be dissociated from the outer textile 4. Thus, it is possible to subject these two elements to different cleaning methods. Generally the outer textile which is, by its position, more exposed to soiling is more energetically and more often cleaned than the insert and the lining which are fragile.

The sealing of the clothing is improved by adding sealing strips to all its seams.

When the clothing is subjected to excessive conditions causing damage to the impermeable layer 2, the user remains protected by the thermostable fiber based layer 1.

The invention also provides a seat comprising a textile covering and foam elements. It comprises an insert mounted loosely between the outer textile and the foam elements, said insert being a composite fireproof and liquid impermeable textile comprising a first non-woven, needled textile layer with a thermostable fiber basis, a second layer formed of a microporous and liquid impermeable film, permeable to water vapour and to carbonic gas and a discontinuous adhesive layer, placed between the first textile layer 1 and the second layer 2 for fixing the second layer 2 to the first textile layer 1, the first layer 1 of the composite textile being placed towards the textile covering.

In a preferred embodiment, this seat comprises elements formed of foam injected in situ and covered at least partially by the composite textile.

The formation of the elements formed of foam injected in situ causes the releases of gas and in particular carbonic gas. The composite textile of the invention forms a barrier confining the foam in the space which is reserved for it and allows discharge without difficulty of the carbonic gas. In fact, the dimension of the carbonic gas molecule is of the same order of size as that of the water molecule and so composite textiles permeable to water vapour are generally also permeable to carbonic gas.

Sealing of the seat will be improved by bonding sealing strips on all its seams.

Numerous embodiments of the composite textile are possible without departing from the scope and spirit of the invention and applications other than those discussed here can be envisaged.

I claim:

1. A fireproof and liquid impermeable composite textile, comprising:

a first textile layer, said first textile layer being a non-woven needled textile having a thermostable fiber basis;

a microporous film, said film being permeable to water vapour but impermeable to liquid water, said film being uninflammable, and said film having a first side and a second side; and a first discontinuous adhesive layer placed between the non-woven needled textile layer and the film for fixing said first side of said film to said first textile layer.

2. The composite textile of claim 1 further comprising:

a second textile layer adjacent to said second side of said film; and a second discontinuous adhesive layer placed between said second textile layer and said film to fix said second textile layer to said second side of said film.

3. The composite textile of claim 1 wherein:

said adhesive layer is formed of spots applied by silkscreen coating.

4. The composite textile of claim 1, wherein:

said adhesive layer is made of a humidity cross-linkable polymer formed by hot spraying.

5. The composite textile of claim 1, wherein:

said first textile layer comprises thermostable polyamideimide fibers.

6. The composite textile of claim 1, wherein:

said film has a polyurethane basis.

7. A protective clothing, comprising:

an outer textile assembly having an outer surface and a first inner surface;

a lining having a second inner surface; and an insert mounted loosely between said first inner surface of said outer textile assembly and said second inner surface of said lining, wherein:

said insert is a fireproof and liquid impermeable composite textile, comprising:

a first textile layer, said first textile layer being a non-woven needled textile having a thermostable fiber basis;

a microporous film, said film being permeable to water vapour but impermeable to liquid water, said film being uninflammable, and said film having a first side and a second side; and a first discontinuous adhesive layer placed between the non-woven needled textile layer and the film for fixing said first side of said film to said first textile layer; and wherein:

said non-woven needled textile faces said second inner surface of said lining and said second of said film faces said first inner surface of said outer textile assembly.

8. The clothing of claim 7, wherein said insert further comprises:

a second textile layer adjacent to said second side of said film; and a second discontinuous adhesive layer placed between said second textile layer and said film to fix said second textile layer to said second side of said film.

9. The clothing of claim 7, wherein said adhesive layer is formed of spots applied by silkscreen coating.

10. The clothing of claim 7, wherein said adhesive layer is a humidity cross-linkable polymer formed by hot spraying.

11. The clothing of claim 7, wherein said non-woven needled textile layer comprises thermostable polyamide-imide fibers.

12. The clothing of claim 7, wherein said film has a basis of polyurethane fireproofed by addition of a nitrogenized and phosphated additive.

13. The clothing of claim 7, wherein said insert and said lining form an assembly which can be disassociated from, and reassociated with, said outer textile assembly.

14. The clothing as defined in claim 13. wherein said assembly formed by said insert and said lining is fixed to said outer assembly by a sliding fastener.

15. A seat, comprising:

a textile covering;

foam elements; and an insert mounted loosely between said textile covering and said foam elements, wherein said insert is a fireproof and liquid impermeable composite textile, comprising:

a first textile layer, said first textile layer being a non-woven needled textile having a thermostable fiber basis;

a microporous film, said film being permeable to water vapour and carbonic gas but impermeable at least to liquid water, said film being uninflammable, and said film having a first side and a second side; and a first discontinuous adhesive layer placed between the non-woven needled textile layer and the film for fixing said first side of said film to said first textile layer; and wherein:

the non-woven needled layer of the composite textile is placed towards said textile covering.

16. The seat of claim 15, wherein said foam elements are made by in situ injection.

17. The seat of claim 15, wherein said adhesive layer is formed of spots applied by silkscreen coating.

18. The seat of claim 15, wherein said adhesive layer is formed of a humidity cross-linkabale polymer formed by hot spraying.

19. The seat of claim 15, wherein said film has a polyurethane basis.

* * * * *